United States Patent [19]

Valtri et al.

[11] Patent Number: 4,756,214

[45] Date of Patent: Jul. 12, 1988

[54] APPARATUS FOR REMOVING A STOPPER FROM A BOTTLE

[75] Inventors: Frank J. Valtri, Warminster; Matthew D. Marhefka, Southampton, both of Pa.

[73] Assignee: Lavaco Industries, Inc., Ivyland, Pa.

[21] Appl. No.: 3,072

[22] Filed: Jan. 14, 1987

[51] Int. Cl.[4] ..... B67B 7/00

[52] U.S. Cl. ..... 81/3.4; 81/3.36; 81/3.45

[58] Field of Search ..... 81/3.4, 3.41, 3.42, 81/3.44, 3.45, 3.57, 3.07, 3.08, 3.36; 29/258, 260, 261, 265, 259, 262

[56] References Cited

U.S. PATENT DOCUMENTS

| | | | |
|---|---|---|---|
| 474,480 | 5/1892 | Mumtord | 81/3.41 |
| 1,596,960 | 8/1926 | Becchetti | 81/3.41 |
| 2,761,338 | 9/1956 | Hardy | 81/3.42 |
| 4,059,883 | 11/1977 | Osborne | 29/259 |
| 4,442,735 | 4/1984 | Chance et al. | 81/3.44 |
| 4,570,319 | 2/1986 | Skoworodko | 29/259 |

*Primary Examiner*—Frederick R. Schmidt
*Assistant Examiner*—Robert Showalter
*Attorney, Agent, or Firm*—Robert C. Podwil

[57] ABSTRACT

An apparatus for removing a stopper from a bottle comprising a threaded shaft member, a bottle-gripping member slidably and rotatably coupled to the shaft member, and a stopper-gripping member threadedly engaged to the shaft member. The bottle-gripping and stopper-gripping members are lightly constructed and relatively flexible, but are buttressed and made rigid and operative by their cooperation with a slidable collar which encircles them and may selectively be positioned for stopper removal or for application of the apparatus to a bottle for stopper removal.

20 Claims, 3 Drawing Sheets

FIG. 1
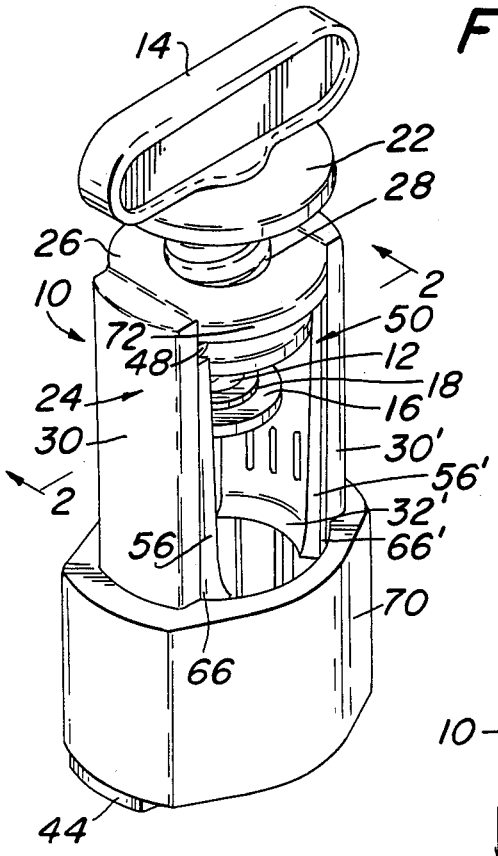
FIG. 2
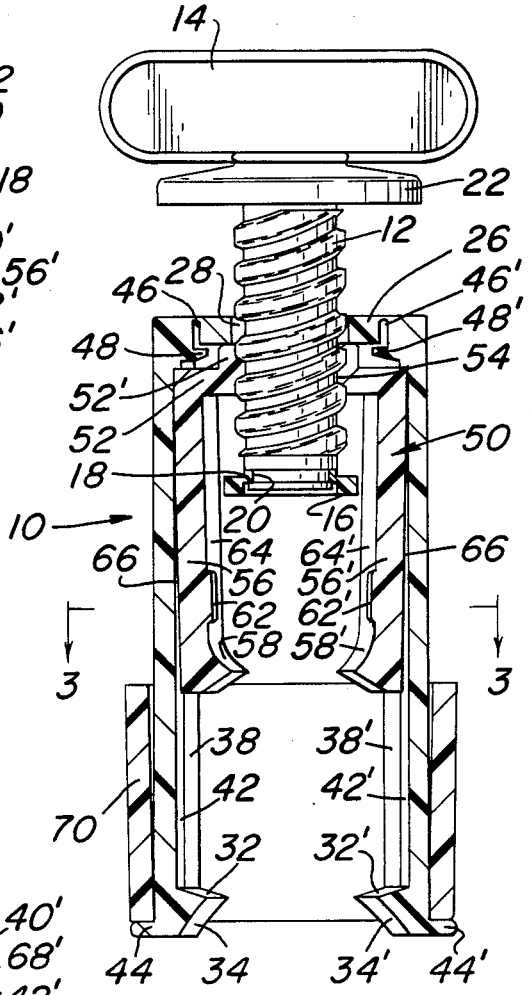
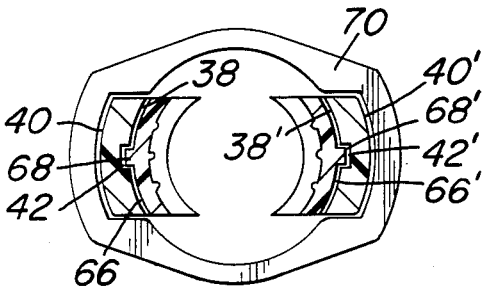
FIG. 3

APPARATUS FOR REMOVING A STOPPER FROM A BOTTLE

BACKGROUND OF THE INVENTION

This invention relates to apparatus for removing a stopper from a bottle, and more particularly, to apparatus in which a stopper-gripping member is caused to be drawn away from the mouth of a bottle to withdraw the stopper mechanically. The invention relates to apparatus for the above purpose in which a bare minimum number of simple, inexpensive and readily manufactured and assembled parts interact to reliably perform the desired function.

Numerous devices have heretofore been proposed for removing stoppers from bottles. By way of example:

U.S. Pat. No. 474,480 issued to Mumford on May 10, 1892 discloses an apparatus in which a pair of prongs is inserted between the cork and the bottle. Turning the handle of the apparatus causes the prongs to move toward each other, thus gripping the cork so that it may be pulled out of the bottle. The movement of the prongs toward each other is effectuated by a rack associated with each prong and a pinion gear which is turned by the handle of the apparatus.

U.S. Pat. No. 1,596,960, issued to Becchetti on Aug. 24, 1926, a tubular member has internal and external screw threads matingly related to one another. The tubular member is attached to a handle and the outer threads threadably engage a bell-shaped member adapted to engage the upper rim of the bottle. The internal threads threadably engage a pair of arms, each of which terminates in a cork-gripping blade adapted to fit between the interior surface of the bottle neck and the cork. As the handle is rotated, the bell-shaped member moves away from the handle to engage the bottle rim while the arms are moved away from the bottle and are gradually brought closer to one another, thereby securing their grip on the cork.

U.S. Pat. No. 2,761,338, issued to Hector-Anthyme Hardy on Sept. 4, 1956, an inner stirrup engages a cork and an outer stirrup engages the upper rim of the bottle. A handle with a screw-threaded bore threadably engages complementary screw threads on a shaft which extends through a bore in the outer stirrup and is secured to the inner stirrup. The handle is adapted to rotatably grip the outer stirrup, and as the handle is turned, the shaft is moved away from the bottle to extract the cork.

SUMMARY OF THE INVENTION

In general, the present invention is an apparatus for removing mushroom style stoppers from bottles which have a shoulder near the mouth. Champagne, for example, is usually contained in such bottles.

In its presently preferred form, the apparatus employs a hand rotatable threaded shaft member to draw a stopper-gripping member away from the bottle, thereby withdrawing the stopper. A handle is affixed to one end of the shaft member, and a base-plate is attached to its other end.

A bottle-gripping member is slidably and rotatably coupled to the shaft member intermediate the handle and the base plate, and includes a pair of opposed bottle-gripping arms extending in the direction of the shaft member to a point beyond said base-plate. The distal ends of the bottle gripping arms are adapted to abut the shoulder of the bottle.

A stopper-gripping member rides on the shaft member, and threadedly engages it, so that rotation of the shaft member causes translation of the stopper gripping member in the direction of the shaft member. The stopper-gripping member is provided with opposed stopper-gripping arms, provided with surfaces which grip the stopper where the stopper meets the mouth of the bottle.

Arms of the bottle-gripping and stopper-gripping members slidably engage each other, and the arms of both members are surrounded by a supporting and reinforcing collar, slidable with respect to the arms. The bottle gripping and stopper-gripping members are lightly constructed and relatively flexible, but are buttressed and made a rigid and operative assembly by their cooperation with the collar. The collar may selectively be positioned for operation of the apparatus to remove a stopper or application of the apparatus to a bottle in preparation for stopper removal.

BRIEF DESCRIPTION OF THE DRAWING

FIG. 1 is a perspective view of an apparatus in accordance with the present invention.

FIG. 2 is a cross-sectional view, taken along the line 2—2 shown in FIG. 1.

FIG. 3 is a cross-sectional view, taken along the line 3—3 shown in FIG. 2.

DETAILED DESCRIPTION OF THE INVENTION

Figure 4:
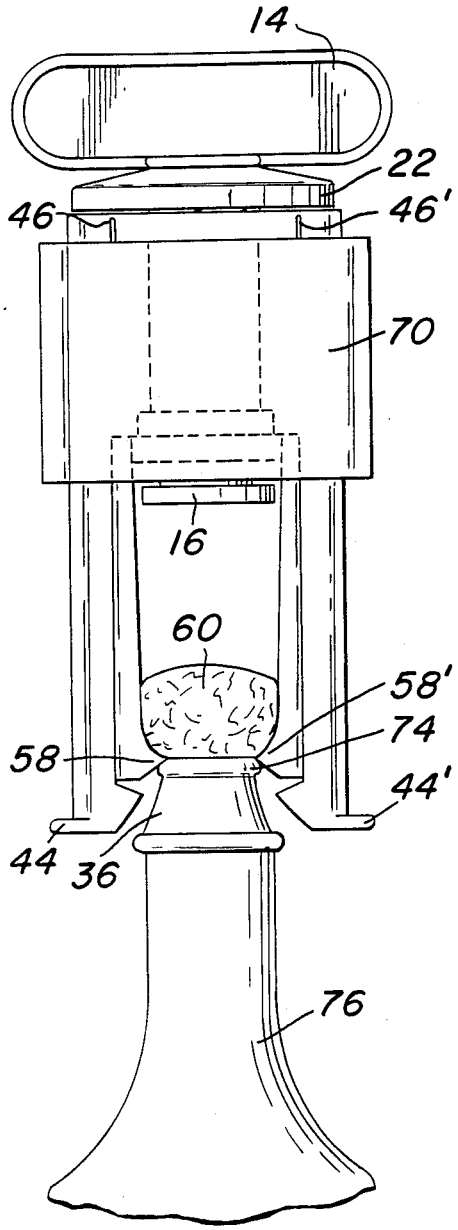
FIGS. 4, 5 and 6 are side-elevational views of the apparatus shown in FIG. 1 at various stages in its operation.

Referring now to the drawings in detail, wherein like reference numerals indicate like elements, there is seen in FIGS. 1 and 2 an apparatus designated generally by the reference numeral 10, for removing stoppers from bottles. The stoppers with which the apparatus 10 may be used can be the bulbous corks found typically on champagne bottles, as well as plastic stoppers having similar or other suitable configurations. The apparatus 10 comprises a threaded shaft member 12, having a handle 14 affixed to it at one of its ends. A base plate 16 is attached at the other end of the shaft member 12. The base plate 16 can be attached to the threaded shaft member 12 by any suitable means, such as snap fitting or ultrasonic welding, and provides a limit stop as explained below. Using this preferred technique, an upper rim 18 on the base-plate 16 is fitted into a complementary recess 20 in the end of the shaft member 12.

A preferred material for making all parts of the present apparatus 1 is polypropylene, although other durable plastics can be used. In the presently preferred embodiment, a flange 22 in the shape of a circular disc is affixed to the shaft member 12 just below the handle 14, and the shaft member 12, handle 14, and flange 22 are integral, i.e., made from one piece of material.

A bottle gripping member, designated generally by reference numeral 24, comprises a first bridging member 26, preferably a circular disc, with an aperture 28 therein. The aperture 28 allows the first bridging member 26 to be slidably and rotatably coupled to shaft member 12 at a point intermediate the flange 22 and the base plate 16. Affixed to or integral with the bridging member 26 is a pair of opposed bottle gripping arms 30, 30'. The arms 30, 30', it will be seen extend longitudinally with respect to the shaft member 12 to a point beyond the base plate 16. The ends of the arms 30, 30' which are from the bridging member 26 are each terminated with an inwardly protruding member 32, 32' shaped to provide a lower surface 34, 34' which is complementary to a shoulder (reference numeral 36 on FIGS. 4–7) typically found on champagne-type bottles. The arms 30, 30' each have an inner surface 38, 38' and an outer surface 40, 40'.

As can be seen best by reference to FIG. 3, the inner surfaces 38, 38' are provided with longitudinal guide grooves 42, 42', the purpose of which is explained below. Preferably, the terminations of the arms 30, 30' are each provided with an outwardly protruding bottom stop members 44, 44'.

It is preferred that arms 30, 30' be slightly flexible so that they may be pulled away from one another so that surfaces 34, 34' to abut the shoulders of different sized bottles. Once released, the arms 30, 30' should fit snugly about the bottle. If, as is preferred, polypropylene, or other durable plastic is used, the bottle-gripping member 24 may be fabricated from a single piece of plastic. The bridging member 26 can be disc-like, as indicated earlier, while positioning of the arms 30, 30' can be facilitated, by providing a notch and self hinge 46, 46' in each arm to allow that arms to be rotated into longitudinal alignment with respect to the shaft member 12. Inwardly projecting lands 48, 48' can be provided to abut the underside of bridging member 26, thus assuring a minimum predetermined spacing between opposed arms 30, 30' and relieving the self hinges 46, 46' of excessive loads. The bottle gripping member 24, it will be understood, may be made integral, molded or stamped in a generally flat configuration, and self-hinged at the self hinges 46, 46' to the configuration seen in the drawings. Making the bottle-gripping member 24 in this configuration and manner facilitates economies in manufacture, by permitting the use of less massive and less complex injection mold tooling.

The above-mentioned flange 22 associated with the shaft member 12 serves to transmit load directly to the arms 30, 30', so that the self hinges 46, 46' are not subjected to substantial loads. Some loads do pass through the self hinges 46, 46', but these loads are provided with an alternate path through the lands 48 and 48'.

A stopper gripping member, indicated generally by reference numeral 50, comprises a second bridging member 52, provided with a threaded aperture 54 arranged to allow the bridging member 52 to be threadedly engaged with shaft member 12 at points intermediate the base plate 16 and the first bridging member 26. Bridging member 52 is preferably a circular disc. Affixed to or integral with the second bridging member 52 is a pair of opposed stopper gripping arms, 56, 56'.

The stopper gripping member, like the bottle gripping member, is preferably made by molding from a single piece of plastic. It will be seen that when the stopper-gripping member is assembled with the shaft member 12, the arms 56, 56' of the bridging member 52 extend longitudinally with respect to the shaft member 12 to a point which is intermediate with respect to the base-plate 16 and the point to which the arms 30, 30' of the bottle gripping member 24 extend. The distal ends of the arms 56, 56' are provided with an inwardly protruding member 58, 58' which are adapted to fit under the stopper (reference numeral 60 on FIG. 4 and 60' in FIG. 7) and above the rim of the bottle (reference numeral 36 in FIGS. 4–7). The members 58, 58' may be complemented by a series of parallel, spaced inwardly protruding or raised ridges or projections 62, 62' which secure the grip on the stopper 60.

The arms 56, 56' have inner surfaces 64, 64' and outer surfaces 66, 66'. In this regard, the outer surfaces 66, 66' are preferably provided with guides 68, 68' which are adapted to fit into the guide grooves 42, 42'. The engagement of guides 68, 68' with grooves 42, 42' prevents bottle-gripping member 24 and stopper gripping member 50 from rotating with respect to one another when shaft member 12 is rotated with respect by turning handle 14. The arms 56, 56', it will be understood, are normally spaced apart such that their outer surfaces 66, 66' are in slidable engagement with inner surfaces 38, 38' of arms 30, 30'.

While the guides 68, 68' and grooves 42, 42' can be used to prevent rotation of arms 30, 30' and 56, 56' with respect to one another, other equivalent means for preventing relative rotation will occur to those skilled in the art. Similarly if guides and the grooves of the kind illustrated are used, guides like the guides 68, 68' may be placed on the bottle-gripping arms 30, 30' and grooves like the grooves 42, 42' on the stopper gripping arms 56, 56'.

Referring again to FIGS. 1 and 2, a slidable reinforcing collar 70 surrounds and partly encloses the bottle-gripping arms 30, 30' and stopper gripping arms 56, 56', to buttress and rigidify them. The collar 70 is preferably sized to provide a snug, but slidable fit over the outside surfaces 40, 40' of arms 30, 30'. The first bridging member 26 may advantageously be sized to provide a protruding section 72 whose diameter is such that it prevents collar 28 from sliding upwardly beyond the underside of the protruding section 72. Similarly, the bottom stop members 44, 44' serve to normally limit travel of collar 70 downwardly beyond the distal ends of the bottle-engaging arms 30, 30'. Collar 70 can be removed, however, from the apparatus 10 if so desired by squeezing the arm members 30, 30' together and sliding the collar 70 beyond protruding stop members 44, 44' and ultimately off the apparatus 10.

The collar 70, it will be seen, serves to rigidify the entire assembly and to resist lateral forces tending to spread the distal ends of the arms 30, 30', 56, 56'. Such forces, if allowed to cause such spreading, would result in unwanted disengagement of the arms 30, 30', 56, 56' from the shoulder 36 and stopper 60, 60'.

Figure 5:
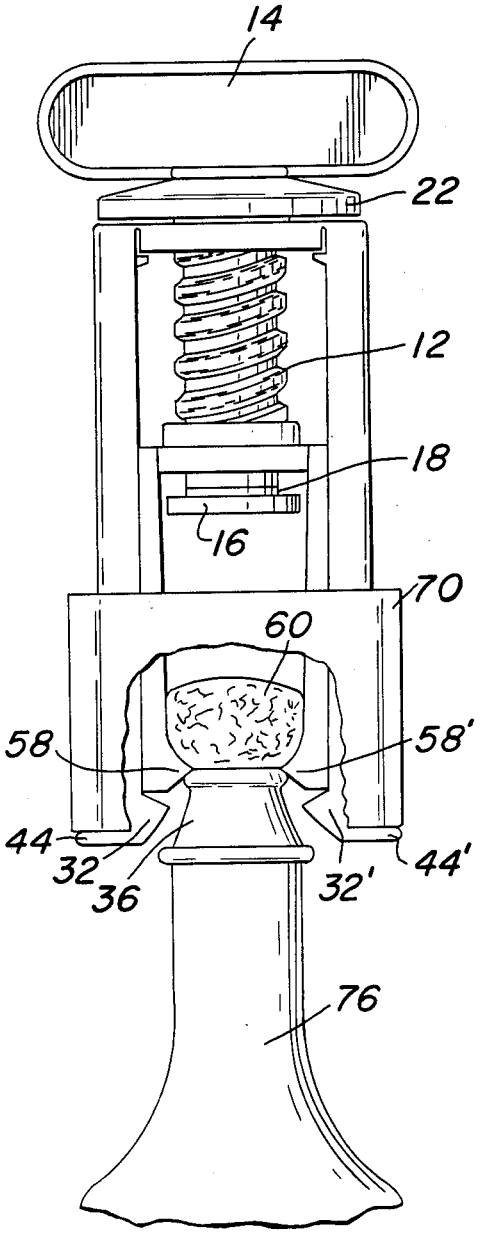
Figure 6:
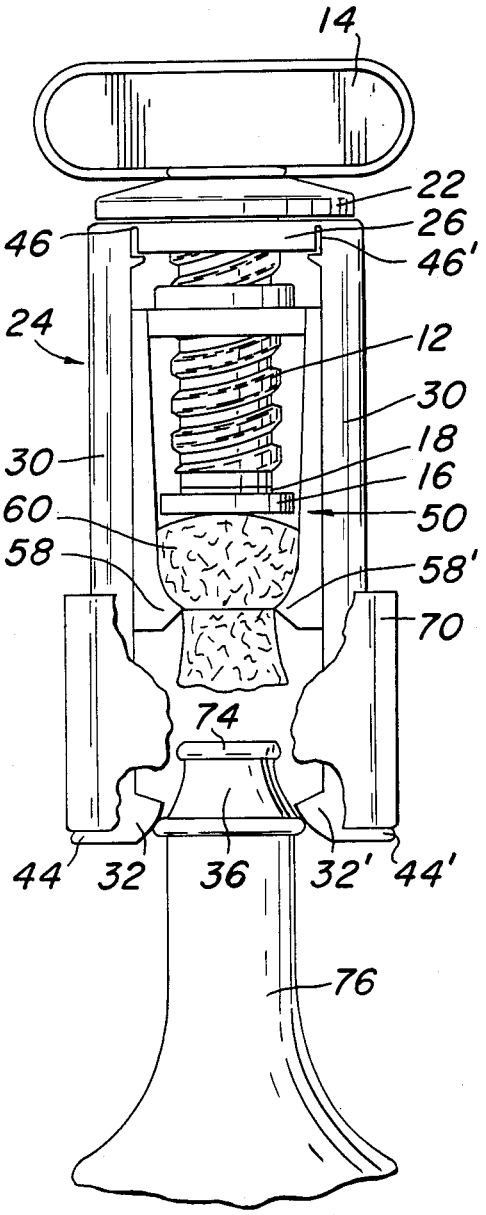

The use of apparatus 10 in accordance with the present invention ma be illustrated with reference to FIGS. 4, 5, and 6. In this regard, the apparatus 10 is initially adjusted as shown in FIG. 4, so that shaft member 12 is screwed into second bridging member 52 until the bridging member 52 is at its most extended position at the end of the shaft member 12 and against the "stop" provided by the base plate 16. The collar 70 is placed in its uppermost position. The lengths of arms 30, 30' and 56, 56' are such that with the apparatus 10 thus configured, protruding members 58, 58' are able to fit beneath the stopper 60 and above the lip 74 of the bottle 76, while protruding members 32 and 32' are between the lip 74 and shoulder 36 of the bottle 76. Due to the position of the collar 70, the apparatus 10 may be moved laterally to the desired position over the stopper 60. The flexibility of the arms 30, 30' and arms 56, 56' also facilitates initial positioning. Next, as is seen in FIG. 5, while maintaining the protruding members 32, 32' and 58, 58' in place, collar 70 is moved to its lowermost position.

Turning of the handle 14 causes the surfaces 34, 34' of the inwardly projecting members 32, 32' to firmly impinge upon the shoulder 36 and the inwardly projecting members 58, 58' to exert an extracting force on the stopper 60 and pull the stopper from the bottle.

Figure 7:
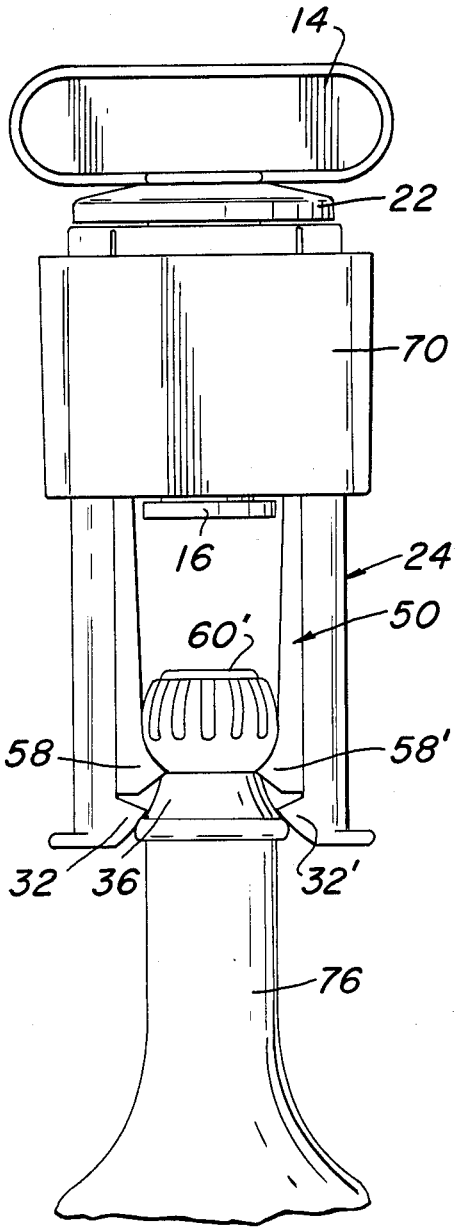

FIG. 7 illustrates a variation of the mode of operation of the apparatus 10, when the apparatus 10 is used in connection with bulbous plastic stoppers such as the cap 60' in FIG. 7, rather than natural corks. In such situations, the lip 74 seen in FIGS. 4–6 is typically covered by the stopper 60', so that gripping surfaces of the members 58, 58' are placed beneath a lower aspect of the stopper 60' in engagement with the shoulder 36. The collar 70 may then be positioned, and the shaft member 12 actuated, as before.

The present invention may be embodied in other specific forms without departing from its spirit or essential attributes. Accordingly, reference should be made to appended claims rather than the foregoing specification, as indicating the scope of the invention.

What is claimed is:

1. Apparatus for removing a mushroom style stopper from a bottle having a shoulder near the mouth thereof, comprising a threaded shaft member having a handle affixed at one end thereof and a stop member at the other end thereof;

a bottle gripping member comprising a first bridging member slidably and rotatably coupled to said shaft member intermediate said handle and said stop member, a pair of opposed bottle gripping arms attached at one end to said first bridging member and extending longitudinally with respect to said shaft member to a point beyond the distal end of said shaft member, the other ends of said bottle-gripping arms being adapted to abut the shoulder of the bottle, said bottle-gripping arms having inner and outer surfaces;

a stopper-gripping member comprising a second bridging member having a threaded aperture therein, said second bridging member being threadedly engaged on said shaft member intermediate said first bridging member and said distal end of said shaft member, a pair of opposed stopper-gripping arms attached at one end to said second bridging member and extending longitudinally with respect to said shaft member to a point intermediate said distal end of said shaft member and said point to which said bottle-gripping arms extend, the other ends of said stopper-gripping arms being adapted to grip the stopper, said cork-stopper gripping arms having inner and outer surfaces, said bottle-gripping arms being spaced from each other such that said outer surfaces of said stopper gripping arms are in slidable engagement with said inner surfaces of said opposed bottle-gripping arms; and means for preventing said stopper-gripping arms from rotating out of slidable engagement with said opposed bottle-gripping arms; and a collar adapted to slidably fit over said outer surfaces of said bottle-gripping arms.

2. The apparatus of claim 1 wherein said threaded shaft member has a flange affixed thereto below said handle.

3. The apparatus of claim 2 wherein said handle, said flange, and said threaded shaft member are integral.

4. The apparatus of claim 3 which is made of polypropylene.

5. The apparatus of claim 4, said stop member comprising a base plate rotatably coupled to said distal end of said shaft member.

6. The apparatus of claim 5, whereas said base plate is coupled to said distal end by ultrasonic welding.

7. The apparatus of claim 5 wherein said base plate is coupled to said distal end by a snap fit.

8. The apparatus of claim 1 wherein said first bridging member is a circular disc having an aperture therein.

9. The apparatus of claim 8 wherein said first bridging member and said bottle-gripping arms are integral.

10. The apparatus of claim 9 which is made of polypropylene.

11. The apparatus of claim 1 wherein said second bridging member is a circular disc having a threaded aperture therein.

12. The apparatus of claim 1 wherein said second bridging member and said stopper-gripping arms are integral.

13. The apparatus of claim 12 which is made of polypropylene.

14. The apparatus of claim 12 wherein said bottle-gripping arms have protruding members adapted to maintain said collar in slidable engagement with said bottle-gripping arms.

15. The apparatus of claim 1 wherein said inner surfaces of said stopper gripping arms are provided with a plurality of spaced, raised ridges.

16. The apparatus of claim 1 wherein said means for preventing said outer surfaces of said opposed stopper-gripping arms from rotating out of slidable engagement with said inner surfaces of said opposed bottle-gripping arms comprises guide means on each of said outer surfaces of said stopper-gripping arms and a complementary guide means in each of said inner surfaces of said bottle-gripping arms.

17. Apparatus for removing a mushroom style stopper from a bottle, comprising a threaded shaft member having a handle affixed at one end;

a bottle-engaging member slidably and rotatably coupled to said shaft member and having a pair of opposed bottle-engaging arms thereon, said bottle-engaging arms extending longitudinally with respect to said shaft member to a point beyond the distal end of said shaft member, distal ends of said bottle-engaging arms being adapted to abut an upper surface of the bottle;

a stopper-gripping member threadedly engaged with said shaft member and having a pair of opposed stopper-gripping arms received between said bottle engaging arms, said stopper-gripping arms extending longitudinally with respect to said shaft member to a point intermediate said distal end of said shaft member and said distal ends of said bottle engaging arms and having means thereon for gripping a stopper, said respective pairs of bottle-engaging arms and stopper-gripping arms being in slidable engagement with each other for relative movement longitudinally relative to said shaft member;

and a collar surrounding and in slidable engagement with said bottle-engaging arms to limit deformation of said bottle-engaging and said stopper-gripping arms when said apparatus is operatively disposed.

18. The apparatus of claim 17, wherein said bottle-engaging arms and said stopper-gripping arms are flexible, so as to facilitate assembly of said collar and said bottle-engaging arms.

19. The apparatus of claim 18 wherein said bottle-engaging arms have outwardly protruding members adapted to maintain said collar in slidable engagement with said bottle-gripping arms.

20. Apparatus for removing a mushroom style stopper from a bottle, comprising:

a threaded shaft member having a handle affixed at one end;

a bottle-gripping member slidably and rotatably coupled to said shaft member and having a pair of bottle-engaging arms thereon;

a stopper gripping member threadedly engaged to said shaft member and slidably received between said bottle-engaging arms, said handle and said shaft member being selectively rotatable to withdraw the stopper; and a collar surrounding and in slidable engagement with said bottle-gripping member and selectively movable between a first position facilitating application of the apparatus to a bottle and a second, operative position for stopper removal, said bottle-gripping and said stopper-gripping members being buttressed and rigidified by said collar member when said collar member is in said operative position.

* * * * *